US006958733B1

(12) United States Patent
Jung

(10) Patent No.: US 6,958,733 B1
(45) Date of Patent: Oct. 25, 2005

(54) MICRO ANTENNA DRIVING APPARATUS FOR USE IN MOBILE PHONE

(75) Inventor: Sung Tai Jung, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/968,055

(22) Filed: Oct. 20, 2004

(30) Foreign Application Priority Data

Jun. 30, 2004 (KR) ..... 10-2004-50150

(51) Int. Cl.[7] ..... H01Q 1/24
(52) U.S. Cl. ..... 343/702; 343/901
(58) Field of Search ..... 343/702, 900, 343/901, 902, 903; H01Q 1/24

(56) References Cited

U.S. PATENT DOCUMENTS 6,239,754 B1 * 5/2001 Kim ..... 343/702
6,337,671 B1 * 1/2002 Lee ..... 343/901
6,429,817 B1 * 8/2002 Creigh et al. ..... 343/702

* cited by examiner

*Primary Examiner*—Hoanganh Le
(74) *Attorney, Agent, or Firm*—Lowe Hauptman & Berner, LLP

(57) ABSTRACT

A micro antenna driving apparatus is installed in a housing of the mobile phone so as to extend or retract the antenna, and comprises a driving motor, and a decelerator. The driving motor includes a motor body provided with a magnet, and a shaft inserted in the motor body and surrounded by a coil. The decelerator is coupled to the motor body so as to be installed at one end of the shaft, and has an output shaft fixed in the housing. The antenna is installed in the housing such that it comes into contact with the motor body. Thereby, the antenna can be extended or retracted according to rotation of the driving motor while coming into direct contact with the motor body of the driving roller without requiring a separate driving roller, resulting in a reduction in an installation space of the antenna driving apparatus.

19 Claims, 7 Drawing Sheets

MICRO ANTENNA DRIVING APPARATUS FOR USE IN MOBILE PHONE

RELATED APPLICATIONS

This application claims the benefit of Korean Patent Application No. 2004-50150 filed on Jun. 30, 2004 in the Korean Intellectual Property Office, the disclosure of which is incorporated herein by reference.

BACKGROUND OF THE INVENTION

1. Field of the Invention

The present invention relates to an apparatus for use in extension or retraction of an antenna out of and into a portable communication terminal, and more particularly to a micro antenna driving apparatus adapted to extend or retract an antenna according to rotation of a motor body thereof in contact with the antenna.

2. Description of the Related Art

In general, portable communication terminals comprise various shapes of antennas. The antennas serve to improve transmission and reception sensitivity of the portable communication terminals. Such an antenna is usually retracted into a housing of the portable communication terminal, such that it can be extended out of the housing whenever it is necessary.

In a state wherein the antenna is extended out of the housing of the portable communication terminal, the antenna is connected to the portable communication terminal by passing through an antenna casing installed at an upper end of the housing, thereby serving to improve transmission and reception sensitivity of the portable communication terminal.

Although the antenna is generally configured so as to be manually extended out of the housing in use, for maximizing the convenience of use, the antenna may be configured such that it can be automatically extended or retracted under the operation of driving means.

As shown in FIG. 1, the conventional antenna driving system of a mobile phone comprises a driving roller 102, a driven roller 104, an antenna 106, a decelerator module 110, and a flexible connection member 130.

The driving roller 102 and the driven roller 104 have respective shafts 102*a* and 104*a*, which are rotatably fitted in a main bracket 108. The antenna 106 is interposed between the driving roller 102 and the driven roller 104, such that it is pushed down by the driven roller 104 to press an outer peripheral surface of the driving roller 102.

The driving roller 102 is adapted to be driven by means of the decelerator module 110 installed at a lateral side of the main bracket 108. The decelerator module 110 comprises a driving motor 112 and a plurality of reduction gears.

The flexible connection member 130 is installed between a driving shaft (not shown) of the above described decelerator module 110 and the shaft 102*a* of the driving roller 102. Such a flexible connection member 130 effectively transmits rotation power generated from the decelerator module 110 to the driving roller 102, even if the driving shaft (not shown) of the decelerator module 110 is not aligned on the same axis as the shaft 102*a* of the driving roller 102.

As can be seen from FIG. 2, if the decelerator module 110 is driven to generate the rotation power, the rotation power is transmitted to the shaft 102*a* of the driving roller 102 through the flexible connection member 130, resulting in rotation of the driving roller 102.

As the driving roller 102 rotates as stated above, the antenna 106, interposed between the driving roller 102 and the driven roller 104, linearly moves such that it is extended or retracted out of or into a housing 101 of the mobile phone.

The above described the antenna driving system of a mobile phone according to the prior art, however, has a problem as follows.

As shown in FIG. 2, since the antenna driving system of a mobile phone comprises the decelerator module 110, and the main bracket 108 containing the driving roller 102 and driven roller 104, it requires an excessively large installation space.

In order to solve the above problem, it has been proposed to decrease the sizes of the driving roller 102 and the driven roller 104, and consequently the main bracket 108.

However, if the sizes of the driving roller 102 and the driven roller 104 decrease, and thus diameters thereof also decrease, it inevitably requires increasing the revolutions per minute of both the driving roller 102 and the driven roller 104 for the extension or retraction of the antenna 106. This causes the antenna 106 to excessively repeatedly come into contact with outer peripheral surfaces of the rollers 102 and 104, resulting in rapid wear of the rollers 102 and 104.

Further, since the rollers 102 and 104 are made of a rubber material in order to endow the antenna 106 with a prescribed frictional force, when the antenna 106 is pushed down by the driven roller 104 to press the outer peripheral surface of the driving roller 102, the rollers 102 and 104 may be permanently deformed, resulting in a deterioration in operational stability of the antenna 106.

SUMMARY OF THE INVENTION

Therefore, the present invention has been made in view of the above problems, and it is an object of the present invention to provide a micro antenna driving apparatus of a simplified structure adapted to extend or retract an antenna according to rotation of a motor body in contact with the antenna, thereby reducing a required installation space, preventing permanent deformation of roller means due to the antenna, and reducing wear of the roller means.

In accordance with one aspect of the present invention, the above and other objects can be accomplished by the provision of a micro antenna driving apparatus installed within a housing of a mobile phone for reciprocating the antenna out of and into the housing, comprising: a driving motor including a hollow cylindrical motor body having a magnet attached thereto, a shaft inserted into the motor body, a coil disposed around the shaft, the motor body being arranged across the reciprocating direction of the antenna which is in contact with an outer peripheral surface of the motor body; and a decelerator coupled with the motor body, the decelerator including an input end connected with one end of the shaft and an output shaft fixed within the housing of the mobile phone, the output shaft rotating at a speed decelerated from that applied to the input end, whereby the motor body is rotated by the actuation of the driving motor so as to reciprocate the antenna out of and into the housing.

Preferably, the micro antenna driving apparatus may further comprise a guiding roller elastically installed in the housing of the mobile phone such that it comes into contact with the outer peripheral surface of the motor body, whereby the antenna is interposed between the motor body and the guiding roller.

Preferably, one end of the motor body may be formed with a male screw portion, and input end of the decelerator is formed with a female screw portion, whereby the motor body and the decelerator are threadedly coupled to each other.

Preferably, the outer peripheral surface of the motor body may be formed with a rubber coating layer, and the rubber coating layer may be a urethane coating layer.

Preferably, the guiding roller may include a guiding roller shaft fixedly inserted in a longitudinal direction of the guiding roller, support blocks adapted to rotatably support both ends of the guiding roller shaft and inserted in respective guiding grooves provided at the housing, and elastic members interposed between the respective support blocks and the housing, whereby the guiding roller is elastically installed in the housing.

Preferably, the guiding roller may be inwardly curved at an outer periphery thereof such that it has a minimum diameter at the center of a longitudinal direction thereof.

Preferably, the guiding roller may be formed at an outer peripheral surface thereof with a rubber coating layer, and the rubber coating layer may be a urethane coating layer.

In accordance with another aspect of the present invention, there is provided a micro antenna driving apparatus installed within a housing of a mobile phone for reciprocating the antenna out of and into the housing, comprising: a driving motor including a hollow cylindrical motor body having a magnet attached thereto, a shaft inserted into the motor body, a coil disposed around the shaft, the motor body being arranged across the reciprocating direction of the antenna which is in contact with an outer peripheral surface of the motor body; whereby the motor body is rotated by the actuation of the driving motor so as to reciprocate the antenna out of and into the housing.

Preferably, the driving motor may be a biaxial motor.

Preferably, the micro antenna driving apparatus may further comprise a guiding roller elastically installed in the housing of the mobile phone such that it comes into contact with the outer peripheral surface of the motor body, whereby the antenna is interposed between the motor body and the guiding roller.

Preferably, the driving motor may be a biaxial geared motor having a decelerator installed at an output shaft thereof.

Preferably, the outer peripheral surface of the motor body may be formed with a rubber coating layer, and the rubber coating layer may be a urethane coating layer.

Preferably, the guiding roller may include: a guiding roller shaft fixedly inserted in a longitudinal direction of the guiding roller; support blocks adapted to rotatably support both ends of the guiding roller shaft and inserted in respective guiding grooves provided at the housing; and elastic members interposed between the respective support blocks and the housing, whereby the guiding roller is elastically installed in the housing.

Preferably, the guiding roller may be inwardly curved at an outer periphery thereof such that it has a minimum diameter at the center of a longitudinal direction thereof.

Preferably, the guiding roller may be formed at an outer peripheral surface thereof with a rubber coating layer, and the rubber coating layer may be a urethane coating layer.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
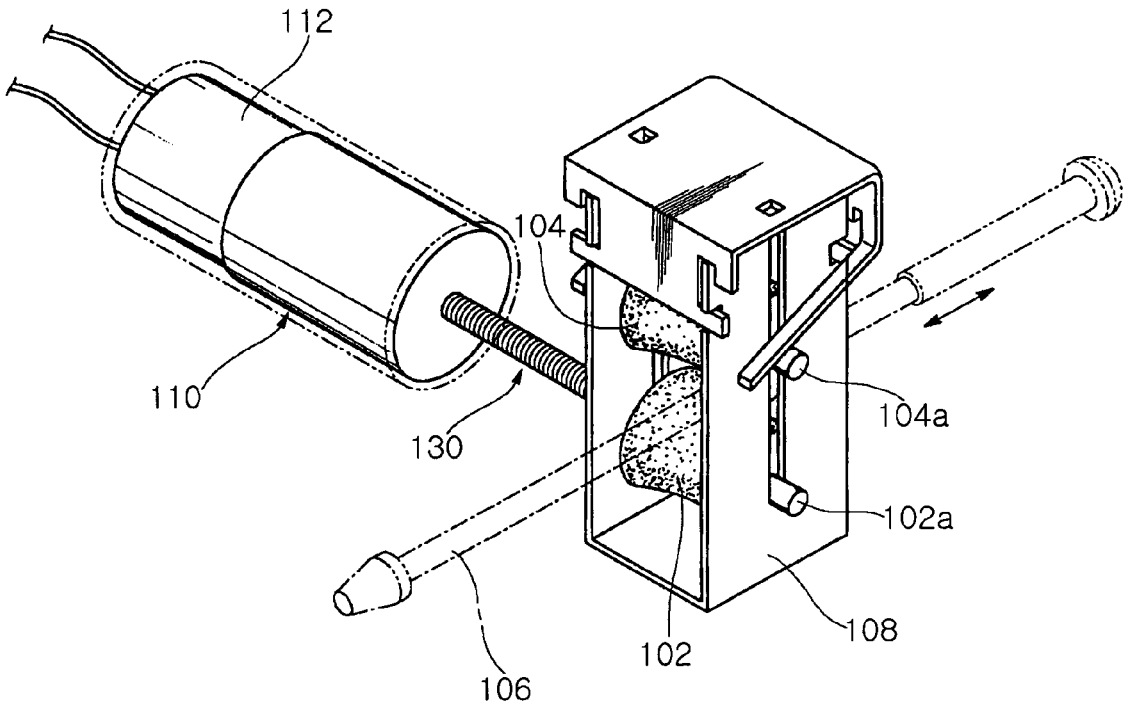
PRIOR ART FIG. 1
FIG. 1 is a perspective view illustrating an automatic extension/retraction antenna system of a mobile phone in accordance with the prior art.
Figure 2:
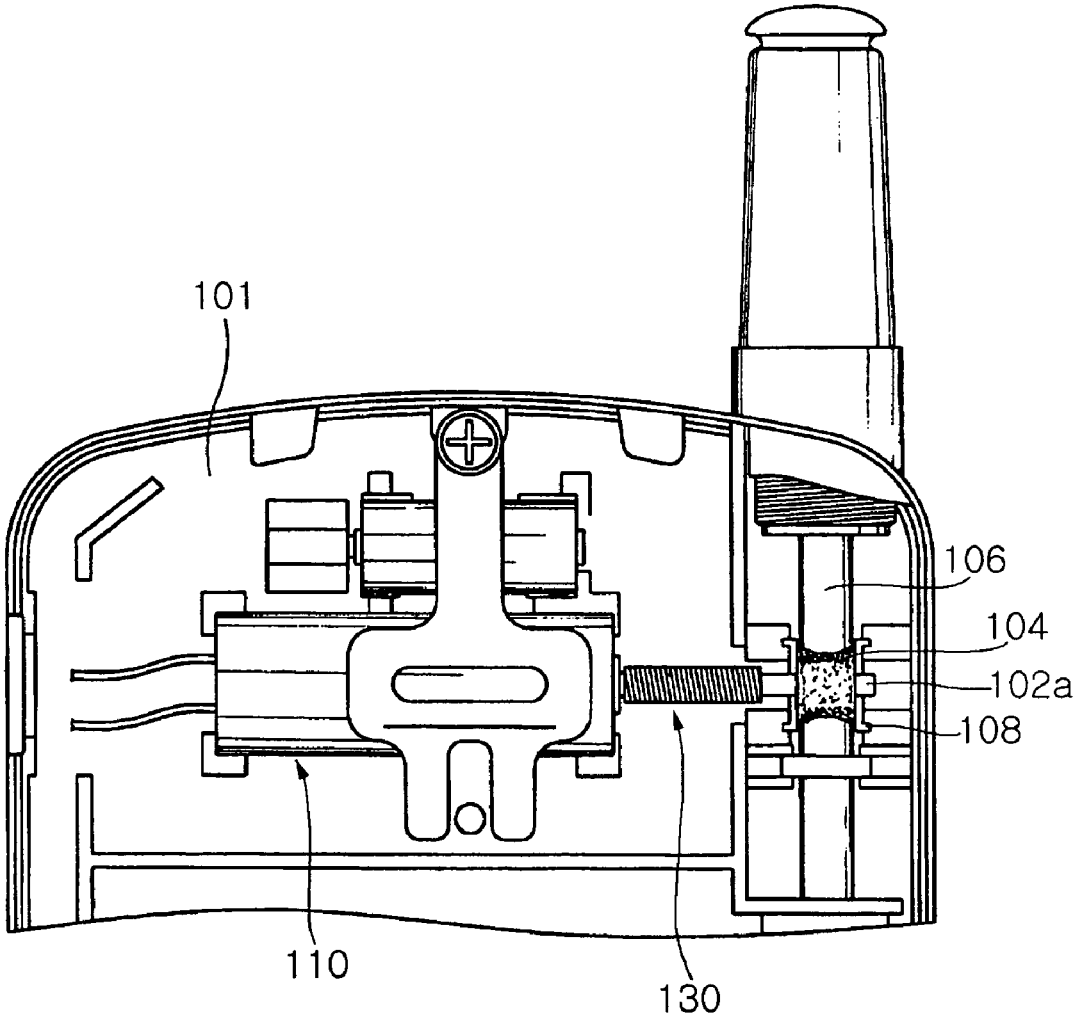
PRIOR ART FIG. 2
FIG. 2 is a sectional view illustrating a housing of a mobile phone, in which the automatic extension/retraction antenna system in accordance with the prior art is mounted.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 3:
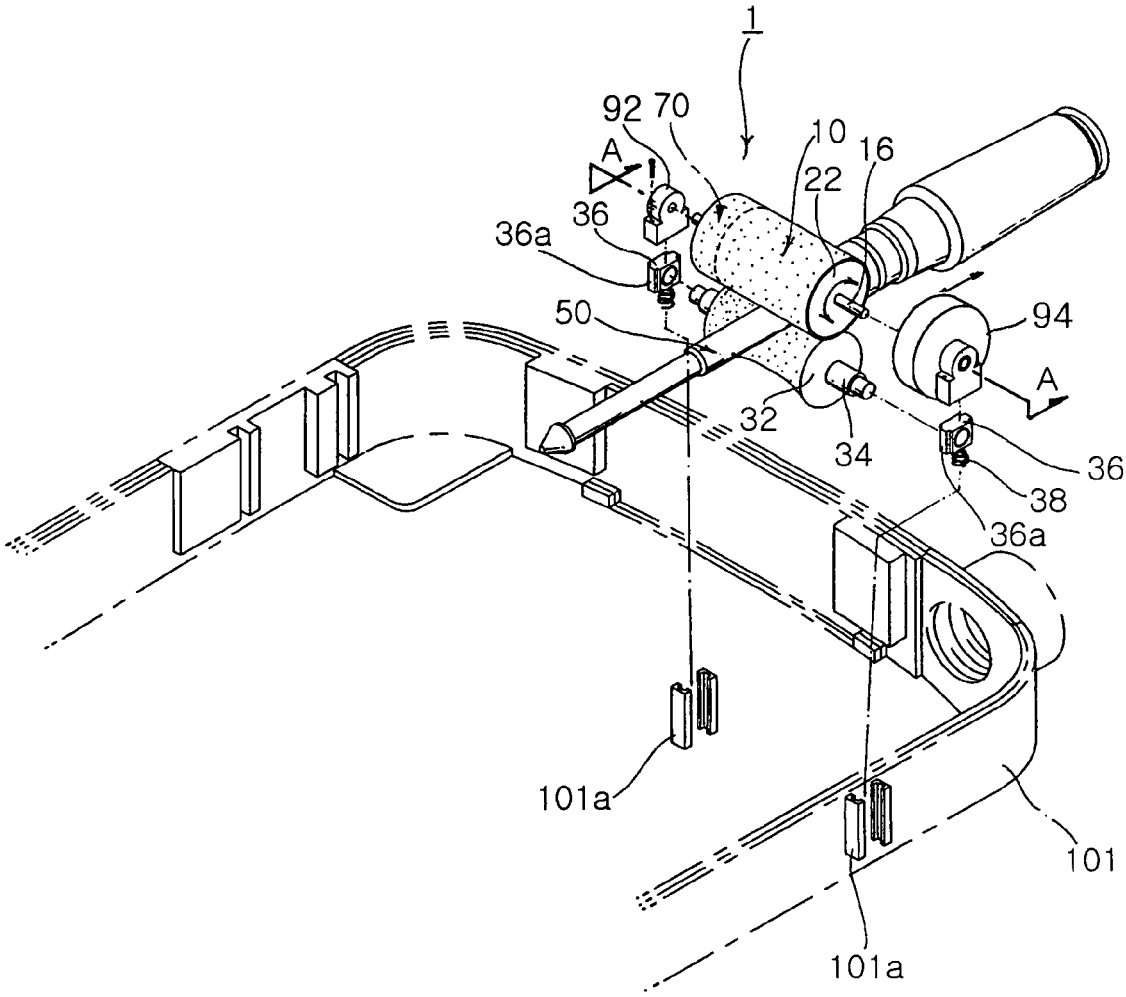
FIG. 3 is an exploded perspective view illustrating a micro antenna driving apparatus in accordance with the present invention.

As shown in FIG. 3, the micro antenna driving apparatus according to the present invention, which is designated as reference numeral 1, comprises a driving motor 10, an antenna 50, and a decelerator 70. The driving motor 10 is coupled with the decelerator 70, and is rotatably mounted in a housing 101 of a mobile phone. The driving motor (10) is arranged across the reciprocating direction of the antenna (50) in the housing (101) so that an outer peripheral surface of a motor body (12) of the driving motor (10) is in contact with an antenna (50).

Figure 4:
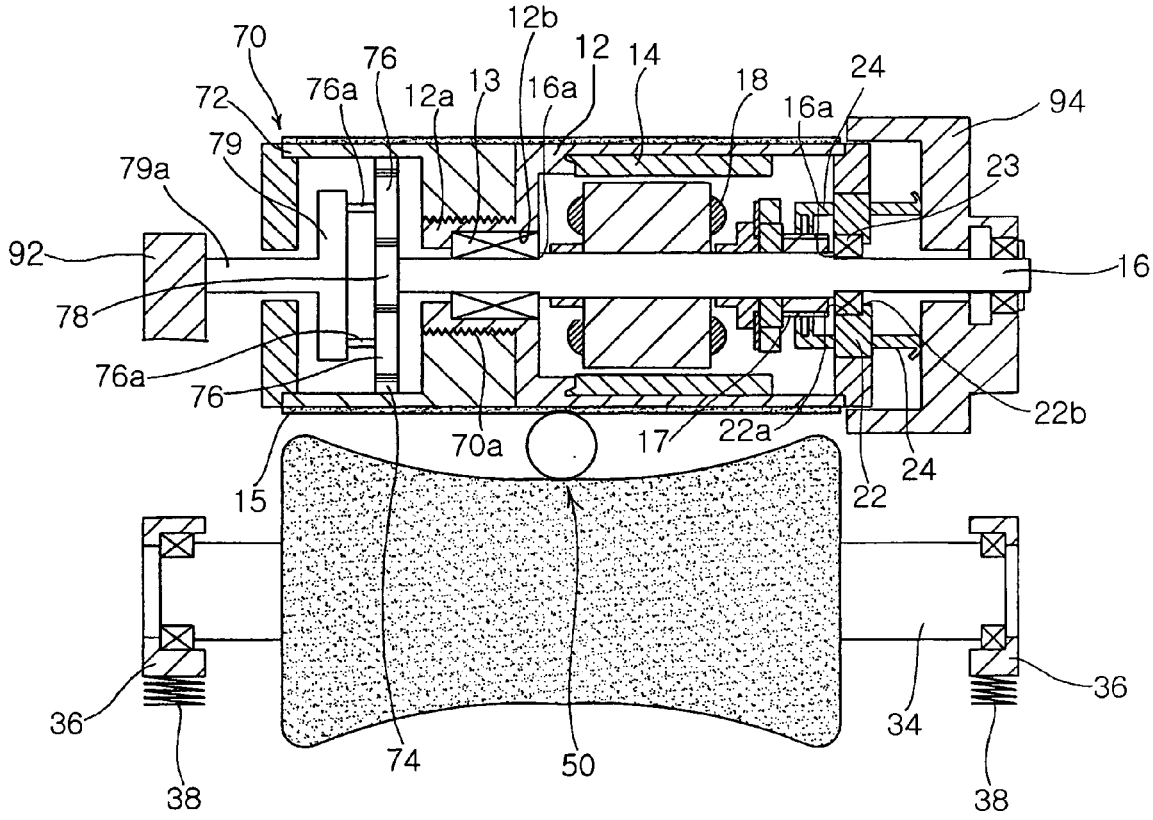
FIG. 4 is a cross sectional view taken along the line A—A shown in FIG. 3.

Referring to FIG. 4, the driving motor 10 comprises a motor body 12, and a shaft 16. The motor body 12 has a hollow cylindrical shape, and along an inner peripheral surface of the motor body 12 is attached a magnet 14. From one end of the motor body 12 protrudes a cylindrical male screw portion 12*a*, which is formed at an outer peripheral surface thereof with threads.

In this case, the male screw portion 12*a* has an outer diameter smaller than an outer diameter of the motor body 12, and is formed at an inner peripheral surface thereof with a first bearing recess 12*b* for use in the insertion of a first bearing 13.

To the other end of the motor body 12 configured as stated above is coupled a fixing cap 22. The fixing cap 22 has a second bearing recess 22*a* formed at an inner peripheral surface thereof for use in the insertion of a second bearing 23, and a through-hole 22*b* concentrically formed with the second bearing recess 22*a*. A brush 24 is fixed at an end surface of the fixing cap 22, such that it penetrates through the fixing cap 22 and protrudes from the other end surface of the fixing cap 22.

The shaft 16, inserted in the motor body 12, is fixedly surrounded around a center portion thereof by a coil 18. Both end portions of the shaft 16 form respective journal portions having a diameter smaller than the center portion. Due to such a difference in the diameters thereof, stepped portions 16*a* are defined between the center portion of the shaft 16, fixedly surrounded by the coil 18, and both the journal portions of the shaft 16.

Meanwhile, the shaft 16 is rotatably inserted in the motor body 12, since the journal portions, formed at both the end portions of the shaft 16, are rotatably supported by the above described first and second bearings 13 and 23, respectively.

In such an inserted state, the coil 18, fixed at the center portion of the shaft 16, is spaced apart from the magnet 14 fixed at the inner peripheral surface of the motor body 12 by a constant distance.

Further, in a state wherein the journal portions, formed at both the end portions of the shaft 16, are rotatably supported by the first and second bearings 13 and 23, the stepped portions 16*a* of the shaft 16 serve to force the first and second bearings 13 and 23 in an axial direction of the shaft 16, thereby preventing the first and second bearings 13 and 23 from moving to the center portion of the shaft 16. In this way, the shaft 16 is only rotatable in the motor body 12 while being restricted in axial movement of the center portion thereof due to the presence of the first and second bearings 13 and 23.

Around one of the journal portions, more particularly, the journal portion formed at a rear end portion of the shaft 16, is attached a commutator 17. The commutator 17 is electrically connected with the coil 18, and is disposed in the motor body 12. With such a configuration, when the fixing cap 22 is coupled to the other end of the motor body 12, an outer peripheral surface of the commutator 17 comes into contact with an inner periphery of the brush 24.

Therefore, if a power supply voltage is applied to the brush 24, current is supplied to the coil 18 through the commutator 17.

As shown in FIG. 4, both the journal portions of the shaft 16 protrude out of the motor body 12, and the decelerator 70 is coupled to one of the journal portions, more particularly, the journal portion formed at a front end portion of the shaft 16. The decelerator 70 is formed at input end thereof with a female screw portion 70*a*, such that the female screw portion 70*a* is threadedly coupled with the male screw portion 12*a* formed at the motor body 12.

The motor body 12 and the decelerator 70 may be formed at their outer peripheral surfaces with a rubber coating layer 15. Preferably, the rubber coating layer 15 may be a urethane coating layer in the present embodiment, but it may be freely selected from among various materials without limitation so long as it can generate a prescribed frictional force while coming into contact with the antenna 50.

The decelerator has an output shaft 79*a*, which is fixed in the housing (not shown in FIG. 4) of the mobile phone so as not to rotate. For this, a fixing block 92 is fixed to a tip end of the output shaft 79*a*, and in turn, the fixing block 92 is fixed in the housing of the mobile phone.

The rear end portion of the shaft 16 is rotatably supported by means of a contact member 94, which contains a bearing, and is fixed in the housing of the mobile phone in the same manner as the fixing block 92.

Figure 5:
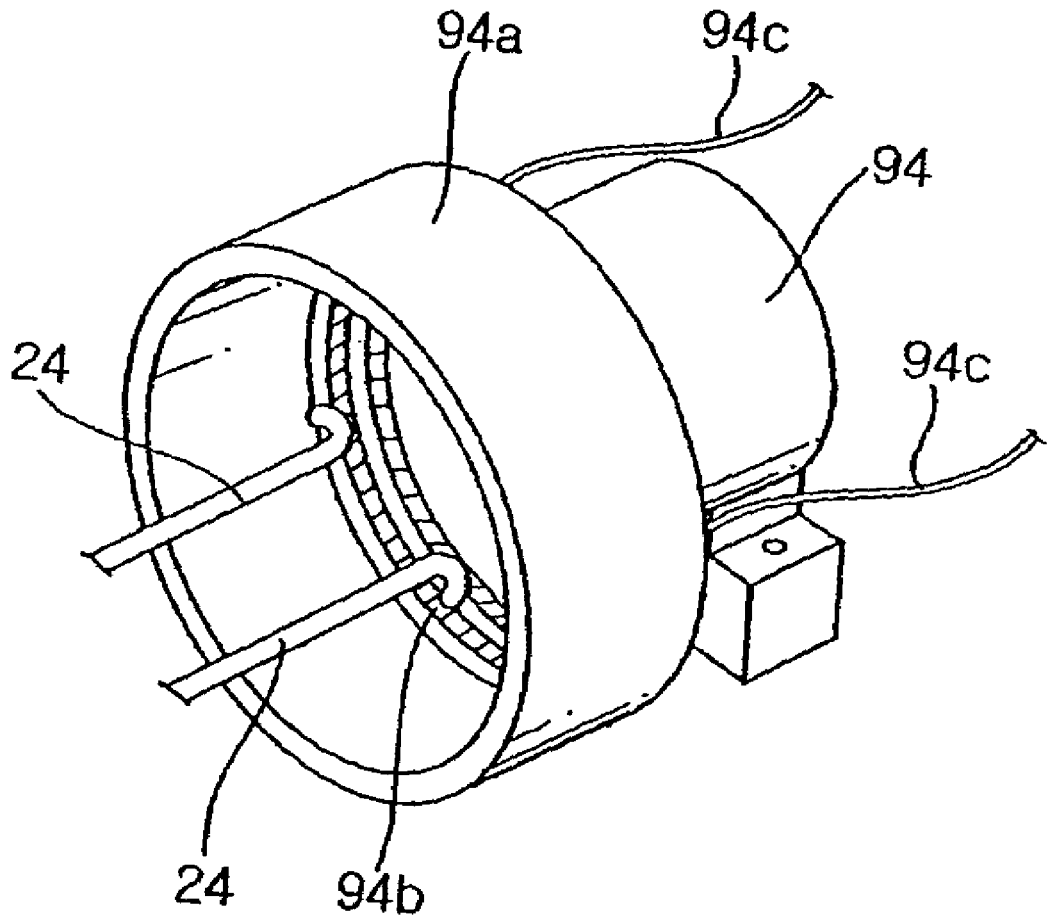
FIG. 5 is a perspective view illustrating a contact member of the micro antenna driving apparatus in accordance with the present invention.

Referring to FIG. 5, the contact member 94 has a contact portion 94*a* having an open end surface. The contact portion 94*a* is internally provided with conductive contacting zones 94*b*. The contacting zones 94*b* may take the form of two annular patterns having different diameters, and are positioned to come into contact with the brush 24.

In this case, the contacting zones 94*b* are electrically connected to an external power source through the use of lead wires 94*c* connected to the contact member 94.

Therefore, in spite of rotation of the shaft 16, the power supply voltage can be applied to the coil 18 through the contacting zones 94*b*, brush 24 and commutator 17.

Meanwhile, referring again to FIG. 3, the antenna 50 is disposed in the housing 101 of the mobile phone such that it comes into contact with an outer peripheral surface of the driving motor 10. Preferably, the antenna 50 is forced upward by means of a guiding roller 32 in order to come into close contact with the outer peripheral surface of the driving motor 10. In this case, in order to force the antenna 50 to come into contact with the outer peripheral surface of the driving motor 10, various other supporting means (not shown) may be formed at an inner surface of the housing 101 of the mobile phone, or other structures (not shown) may be mounted in the housing 101.

The exemplary guiding roller 32, shown in FIGS. 3 and 4, is elastically installed in the housing 101 of the mobile phone, such that it comes into close contact with the outer peripheral surface of the driving motor 10. Therefore, the antenna 50, interposed between the driving motor 10 and the guiding roller 32, can come into close contact with the outer peripheral surface of the driving motor 10.

The guiding roller 32 has a guiding roller shaft 34 fixedly inserted in a longitudinal direction thereof. The guiding roller shaft 34 protrudes from opposite ends of the guiding roller 32.

In this case, to both ends of the guiding roller shaft 34 are coupled respective support blocks 36, and into the support blocks 36 are inserted respective bearings, in order to rotatably support the guiding roller 32.

As shown in FIG. 3, each of the support blocks 36 is formed with a pair of guiding protrusions 36*a*, and to a bottom of the support block 36 is coupled an elastic member, such as a spring 38. In this way, the support block 36 can be elastically supported in the housing 101 of the mobile phone.

Meanwhile, the housing 101 of the mobile phone is provided with a pair of fitting pieces 101*a* internally defining respective guiding grooves. Into the guiding grooves of the fitting pieces 101*a* are inserted the guiding protrusions 36*a* of the support block 36.

In such an inserted state, the spring 38, which is fixed to the bottom of the support block 36, is positioned between the housing 101 of the mobile phone and the support block 36. With such a configuration, the guiding roller 32 is installed in the housing 101 such that it can come into contact with the outer peripheral surface of the motor body 12 of the driving motor 10 by making use of the elasticity of the spring 38.

The guiding roller 32 may have a cylindrical shape, but preferably, an outer periphery of the guiding roller 32 may be inwardly curved such that it has the minimum diameter at the center of a longitudinal direction thereof. Such a configuration effectively prevents the antenna 50 from being separated between the driving motor 10 and the guiding roller 32.

The guiding roller 32 may be made of certain rigid materials, such as for example, metal, synthetic resin, wood, and the like, and may be externally formed with a rubber coating layer. Forming the guiding roller 32 with the rigid materials as stated above has the effect of preventing the guiding roller 32 from being permanently deformed due to the elasticity of the spring 38.

In the same manner as the above described rubber coating layer 15 formed at the outer peripheral surface of the motor body 12, preferably, the rubber coating layer of the guiding roller 32 may be a urethane coating layer, but it can be feely selected from among various materials so long as it can generate a prescribed frictional force while coming into contact with the antenna 50.

Meanwhile, the decelerator 70 may be freely selected from among various types generally used in the art, and a representative example thereof may be a decelerator utilizing the principle of planetary gears.

Figure 6:
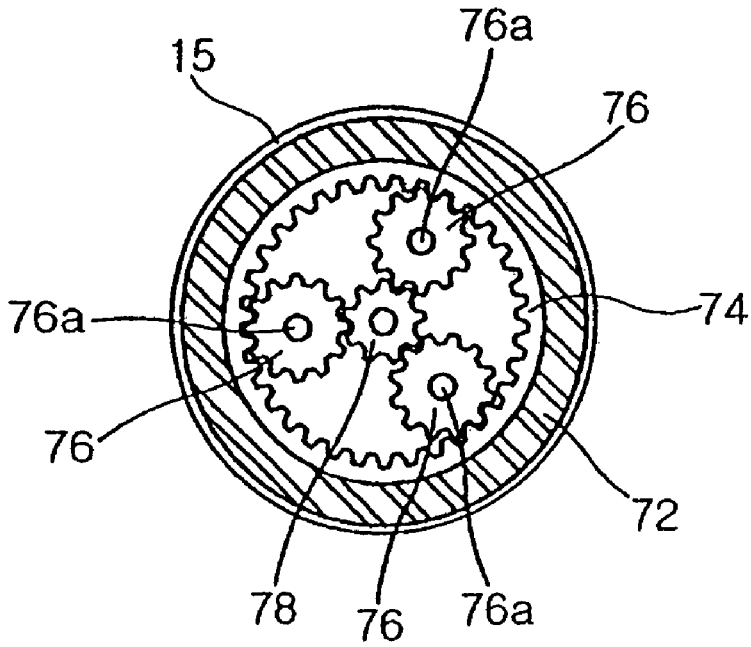
FIG. 6 is a cross sectional view illustrating a decelerator of the micro antenna driving apparatus in accordance with the present invention.
Figure 7:
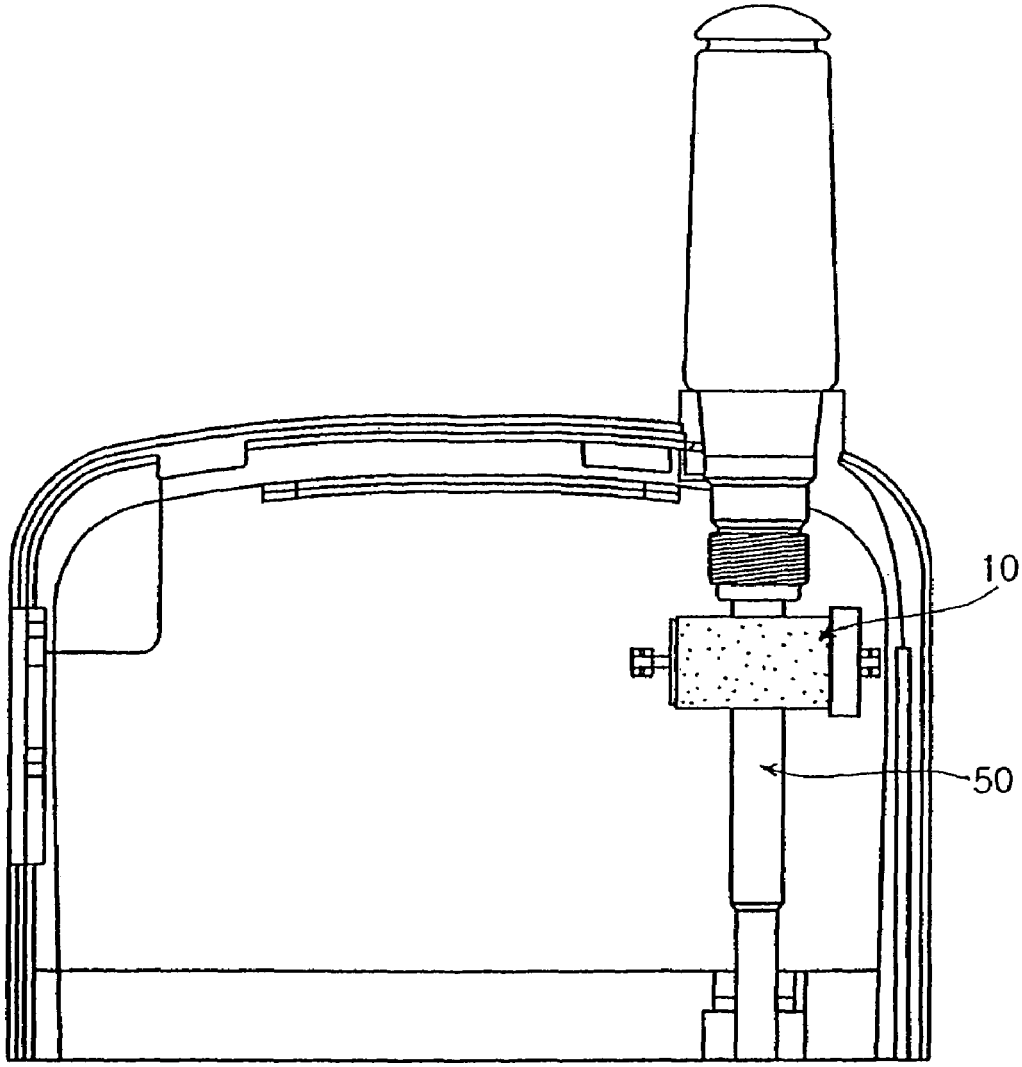
FIG. 7 is a schematic sectional view illustrating a housing of a mobile phone, in which the micro antenna driving apparatus in accordance with the present invention is mounted.

Referring to FIG. 6, the decelerator 70 comprises an annular guiding gear 74 fixed along an inner periphery of an input end of a decelerator body 72, and a plurality of planetary gears 76 coming into external contact with the guiding gear 74 located inside the guiding gear 74. In this case, on a center axis of the decelerator 70 is rotatably installed a driving gear 78, which comes into external contact with the planetary gears 76 located inside the planetary gears 76.

As shown in FIGS. 4 and 6, each of the planetary gears 76 is centrally fixed around a planetary gear shaft 76*a*. The planetary gear shaft 76*a* protrudes laterally from the planetary gear 76 so as to be rotatably connected to an output member 79.

The output member 79 may be rotatably installed in the decelerator body 72, and the output shaft 79*a* protrude from the center of the output member 79.

The driving gear 78 disposed in the input end of the decelerator 70 is coupled to an end of the shaft 16, such that the decelerator 70 is connected with the driving motor 10 in a power transmittable manner. In this case, if the output shaft 79*a* is fixedly maintained relative to the housing 101 of the mobile phone, the shaft 16 is also fixedly maintained so as not to rotate.

The decelerator 70 may take a different structure from the above described embodiment, and is substitutable by other generally well known structures.

As stated above, since the fixing block 92 is coupled to the output shaft 79*a* of the decelerator 70, and the contact member 94 is coupled to the rear end journal portion of the shaft 16 of the driving motor 10, as the fixing block 92 and the contact member 94 are coupled to the housing 101, the driving motor 10 is mounted in the housing 101.

In this case, the journal portion of the shaft 16 is rotatably supported by the contact member 94 having the bearing, and the output shaft 79*a* of the decelerator 70 is fixedly maintained by the fixing block 92 so as not to rotate.

The fixing block 92 and the contact member 94 can be bolted to upper surfaces of pairs of the fitting pieces 101*a* defining the guiding grooves.

As stated above, the outer peripheral surface of the driving motor 10 configured as stated above is adapted to come into contact with the antenna 50. Thereby, the antenna 50 is interposed between the driving motor 10 and the guiding roller 32, such that it can be stably guided by the guiding roller 32, without a risk of unintentional separation, while coming into contact with the outer peripheral surface of the motor body 12 of the driving motor 10.

Therefore, the antenna 50 is adapted to linearly move using the frictional force generated when it comes into contact with the motor body 12 and the guiding roller 32.

In the above described micro antenna driving apparatus in accordance with the present invention, if the power supply voltage is applied to the coil 18 fixed around the shaft 16, the coil 18 interacts with the magnet 14 mounted at the inner peripheral surface of the motor body 12, thereby producing electromagnetic force.

In this case, since the shaft 16 is fixed at one end thereof so as not to rotate, only the motor body 12 is rotatable. Meanwhile, since the input end of the decelerator 70 is threadedly coupled to one end of the motor body 12 so as to be fixed to one end of the shaft 16, the decelerator body 72 is rotatable about the output shaft 79*a* of the decelerator 70.

In this way, when the power supply voltage is applied to the coil 18 as stated above, the motor body 12 of the driving motor 10 rotates in one direction by a predetermined deceleration ratio by means of the decelerator 70.

According to rotation of the motor body 12 of the driving motor 10, the antenna 50, which is forced by the guiding roller 32 to come into contact with the outer peripheral surface of the motor body 12, moves forward or rearward by the frictional force generated between the antenna 50 and the rubber coating layer 15 formed at the outer peripheral surface of the motor body 12, thereby being extended out of the housing 101 of the mobile phone.

If the motor body 12 of the driving motor 10 rotates in the opposite direction of the above direction, under the same principle as the above, the antenna 50 is retracted into the housing 101 of the mobile phone. In this way, the antenna 50 can be automatically extended or retracted out of or into the housing 101 of the mobile phone.

As stated above, since the antenna 50 can be extended or retracted, without requiring a separate driving roller, according to rotation of the motor body 12 of the driving motor 10 in contact with the antenna 50, the micro antenna driving apparatus of the present invention can achieve a considerable reduction in an installation space thereof.

Further, the fact that the driving motor 10 and the guiding roller 32 are directly mounted to the housing 101 of the mobile phone without using a separate fixing bracket enables increasing the diameter of the motor body 12 of the driving motor 10 or the guiding roller 32 corresponding to the space required to install the fixing bracket. Such a direct mounting structure of the driving motor 10 and guiding roller 32, further, effectively prevents the antenna 50 from excessively repeatedly coming into contact at the outer peripheral surface thereof with the motor body 12 of the driving motor 10 and the guiding roller 32, thereby preventing rapid wear of the motor body 12 of the driving motor 10 and the guiding roller 32.

Furthermore, increasing the diameter of the motor body 12 of the driving motor 10 or the guiding roller 32 enables the antenna 50 to be easily extended or retracted with a reduced number of revolutions. This also has the effect of reducing the number of contact times between the antenna 50 and the motor body 12 of the driving motor 10 and the guiding roller 32.

In the case of conventional driving and driven rollers made of a rubber material, they tend to be continuously maintained in a deformed state when an antenna is interposed therebetween, resulting in irrecoverable permanent deformation of the rollers. However, according to the present invention, since the motor body 12 of the driving motor 10 coated with a rubber material substitutes for the driving roller, and the guiding roller 32 also has a separate rubber coating structure, it is possible to eliminate deterioration in operational stability of an antenna due to permanent deformation of the rollers.

Alternatively, the micro antenna driving apparatus according to the present invention may be modified such that the driving motor 10 has no decelerator. That is, other parts of the micro antenna driving apparatus are the same as the above described embodiment, but preferably, the driving motor may be an biaxial motor wherein the shaft 16 protrudes from opposite ends of the motor body 12.

More preferably, the driving motor may be a biaxial geared motor having a decelerator installed at the output shaft. In this case, at least one end of the shaft protruding from the opposite ends of the driving motor may be fixed in the housing of the mobile phone.

As apparent from the above description, the present invention provides a micro antenna driving apparatus of a simplified structure adapted to extend or retract an antenna according to rotation of a motor body of a driving motor in direct contact with the antenna without interposing a separate driving roller, thereby reducing an installation space thereof.

Further, according to the present invention, since the driving motor and a guiding roller are directly mounted in a housing of a mobile phone without using a separate fixing bracket, the diameter of the motor body of the driving motor or the guiding roller increases. This has the effect of preventing an outer peripheral surface of the antenna from excessively repeatedly coming into contact with the motor body of the driving motor and the guiding roller, thereby preventing rapid wear of the motor body of the driving motor and the guiding roller.

Furthermore, as a result of substituting the motor body of the driving motor separately formed with a rubber coating layer for a conventional driving roller, and of adopting the guiding roller having the same rubber coating structure as the motor body, it is possible to prevent deterioration in operational stability of the antenna due to permanent deformation of the motor body and the guiding roller.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A micro antenna driving apparatus installed within a housing of a mobile phone for reciprocating the antenna out of and into the housing, comprising:

a driving motor including a hollow cylindrical motor body having a magnet attached thereto, a shaft inserted into the motor body, a coil disposed around the shaft, the motor body being arranged across the reciprocating direction of the antenna which is in contact with an outer peripheral surface of the motor body; and a decelerator coupled with the motor body, the decelerator including an input end connected with one end of the shaft and an output shaft fixed within the housing of the mobile phone, the output shaft rotating at a speed decelerated from that applied to the input end;

whereby the motor body is rotated by the actuation of the driving motor so as to reciprocate the antenna out of and into the housing.

2. The apparatus as set forth in claim 1, further comprising:

a guiding roller elastically installed in the housing of the mobile phone such that it comes into contact with the outer peripheral surface of the motor body, whereby the antenna is interposed between the motor body and the guiding roller.

3. The apparatus as set forth in claim 1, wherein one end of the motor body is formed with a male screw portion, and input end of the decelerator is formed with a female screw portion, whereby the motor body and the decelerator are threadedly coupled to each other.

4. The apparatus as set forth in claim 1, wherein the outer peripheral surface of the motor body is formed with a rubber coating layer.

5. The apparatus as set forth in claim 4, wherein the rubber coating layer is a urethane coating layer.

6. The apparatus as set forth in claim 2, wherein the guiding roller includes:

a guiding roller shaft fixedly inserted in a longitudinal direction of the guiding roller;

support blocks adapted to rotatably support both ends of the guiding roller shaft and inserted in respective guiding grooves provided at the housing; and elastic members interposed between the respective support blocks and the housing, whereby the guiding roller is elastically installed in the housing.

7. The apparatus as set forth in claim 2, wherein the guiding roller is inwardly curved at an outer periphery thereof such that it has a minimum diameter at the center of a longitudinal direction thereof.

8. The apparatus as set forth in claim 1, wherein the guiding roller is formed at an outer peripheral surface thereof with a rubber coating layer.

9. The apparatus as set forth in claim 8, wherein the rubber coating layer is a urethane coating layer.

10. A micro antenna driving apparatus installed within a housing of a mobile phone for reciprocating the antenna out of and into the housing, comprising:

a driving motor including a hollow cylindrical motor body having a magnet attached thereto, a shaft inserted into the motor body, a coil disposed around the shaft, the motor body being arranged across the reciprocating direction of the antenna which is in contact with an outer peripheral surface of the motor body;

whereby the motor body is rotated by the actuation of the driving motor so as to reciprocate the antenna out of and into the housing.

11. The apparatus as set forth in claim 10, wherein the driving motor is a biaxial motor.

12. The apparatus as set forth in claim 10, further comprising:

a guiding roller elastically installed in the housing of the mobile phone such that it comes into contact with the outer peripheral surface of the motor body, whereby the antenna is interposed between the motor body and the guiding roller.

13. The apparatus as set forth in claim 10, wherein the driving motor is a biaxial geared motor having a decelerator installed at an output shaft thereof.

14. The apparatus as set forth in claim 10, wherein the outer peripheral surface of the motor body is formed with a rubber coating layer.

15. The apparatus as set forth in claim 14, wherein the rubber coating layer is a urethane coating layer.

16. The apparatus as set forth in claim 12, wherein the guiding roller includes:

a guiding roller shaft fixedly inserted in a longitudinal direction of the guiding roller;

support blocks adapted to rotatably support both ends of the guiding roller shaft and inserted in respective guiding grooves provided at the housing; and elastic members interposed between the respective support blocks and the housing, whereby the guiding roller is elastically installed in the housing.

17. The apparatus as set forth in claim 12, wherein the guiding roller is inwardly curved at an outer periphery thereof such that it has a minimum diameter at the center of a longitudinal direction thereof.

18. The apparatus as set forth in claim 12, wherein the guiding roller is formed at an outer peripheral surface thereof with a rubber coating layer.

19. The apparatus as set forth in claim 18, wherein the rubber coating layer is a urethane coating layer.

* * * * *